US005178320A

United States Patent [19]

Bertone

[11] Patent Number: 5,178,320

[45] Date of Patent: Jan. 12, 1993

[54] MAIL BOX WITH SELF CLOSING DOOR

[76] Inventor: Anthony Bertone, 35 Century Trail, Harrison, N.Y. 10528

[21] Appl. No.: 878,621

[22] Filed: May 5, 1992

[51] Int. Cl.[5] ..... B65D 91/00

[52] U.S. Cl. ..... 232/17; 232/45

[58] Field of Search ..... 232/17, 27, 29, 33, 232/28, 45, 47, 51

[56] References Cited

U.S. PATENT DOCUMENTS

| | | | |
|---|---|---|---|
| 522,045 | 6/1894 | Chappell | 232/51 |
| 597,420 | 6/1898 | Kelly | 232/47 |
| 1,209,550 | 12/1916 | Buckwalter | 232/17 |
| 1,564,073 | 12/1925 | Johnson | 232/17 |
| 2,156,858 | 5/1939 | Landis | 232/17 |
| 3,030,058 | 4/1962 | Rosing | 232/17 |
| 3,163,356 | 12/1964 | Joehnk | 232/17 |
| 3,880,344 | 4/1975 | Earle | 232/17 |

*Primary Examiner*—Renee S. Luebke
*Assistant Examiner*—F. Saether
*Attorney, Agent, or Firm*—Martin J. Spellman, Jr.

[57] ABSTRACT

A rural mailbox which has an access door provided with a concealed counterweight to assure that the door closes after use is disclosed. Optionally, the lower surface of the mailbox floor may have a magnet secured to it and positioned so as to contact the counterweight when the door is fully open to temporarily hold the door open. The door further optionally has a covered slot for mail and may be securely locked. The box in one embodiment has an auxiliary covered receptacle mounted on one side to hold mail to be picked up.

6 Claims, 8 Drawing Sheets

MAIL BOX WITH SELF CLOSING DOOR

BACKGROUND OF THE INVENTION

1. Field of the Invention

This invention relates to mail boxes of the style commonly used in rural areas of the type generally mounted on a post or rail and in which a horizontally pivoted door is opened and closed to put in and remove mail.

2. Prior Art

The prior art has utilized awkward arrangements in the past to provide purportedly self closing access doors for rural mail boxes. Such attempts have resulted in complex designs which were expensive to make and/or aesthetically repulsive.

In U.S. Pat. No. 2,527,601, Turnridge, a self closing door of complex structure which does not present a clean and neat appearance of the present design is disclosed.

Mail boxes with door provided with exterior and awkward counter weight arrangements are disclosed in U.S. Pat. No. 1,209,550, Buckwalter and U.S. Pat. No. 1,564,073, Johnson.

The mail boxes having locked doors are well known and U.S. Pat. No. 4,382,540 discloses representative examples of such devices. The lock flange of the present invention, however, is secured behind a heavy door joint to provide a high degree of security.

BRIEF DESCRIPTION OF THE DRAWING

In the accompanying drawing which forms a part of this specification.

SUMMARY OF THE INVENTION

Figure 1:
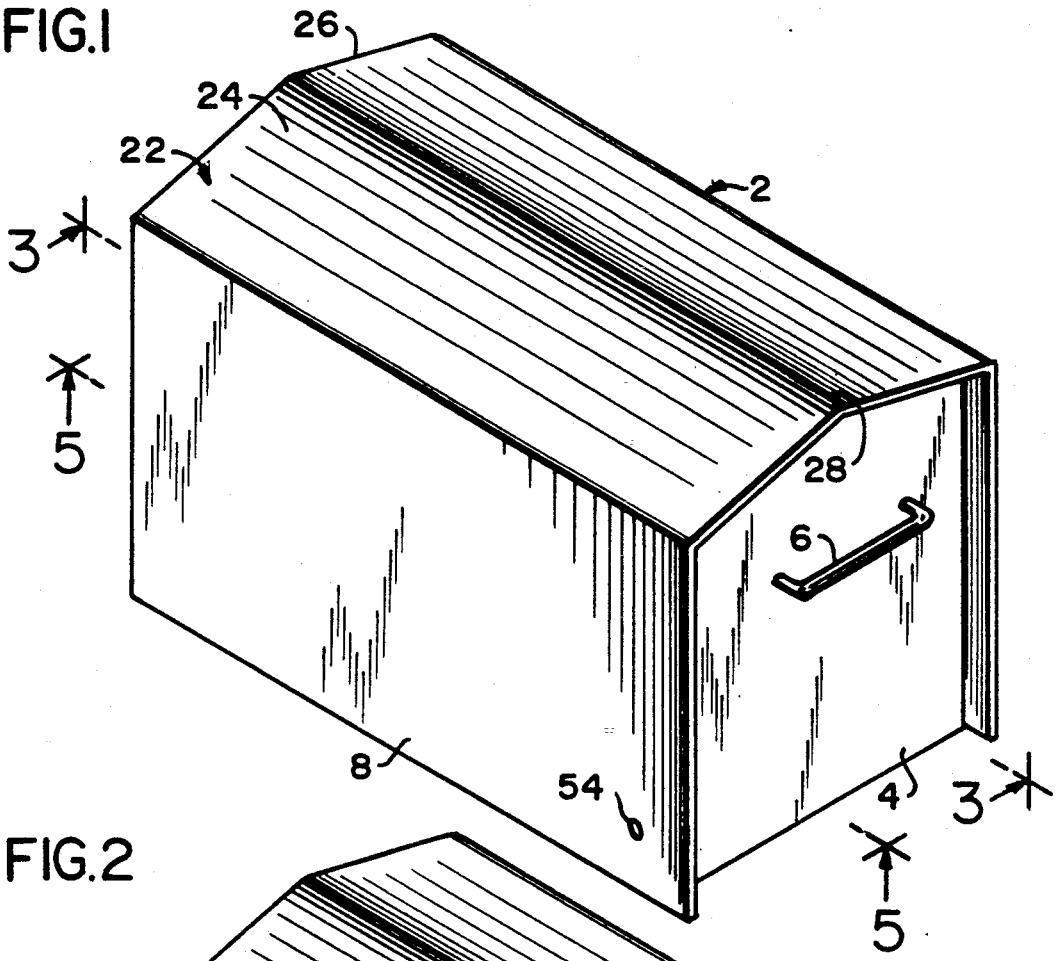
FIG. 1, is a perspective view of the front and left side and top of the mail box according to the present invention.

The present invention concerns a rural type of mail box that is provided with a front access door that may be operated with one hand and that has a generally concealed counterweight attached to its lower inner face which acts to assure that the door automatically closes from a partially or fully opened position upon release by the user. The door is hinged horizontally below the plane of the floor of the box on a pivot pin secured at opposed ends to the spaced apart sides of the box. The pin slidingly passes through apurtures in spaced apart flanges extending normally from the rear surface of the door. The counterweight is below the level of the hinge pin on the door.

In a further aspect of the invention, a magnetic plate is secured to the lower surface of the mail box floor at the forward end portion of the box and located so as to come into surface contact with the door counterweight when the door is opened. This permits the door to be releaseably held temporarily when the door is fully opened, freeing the user's hands for placing and removing mail. When finished, the user initially moves the door to disengage the counterweight and magnet, and the door then fully closes automatically.

In a still further aspect of the invention, the mail box door is provided with a cylinder lock having a flange arm which in the locked position extends behind an angle iron door jamb or stop to provide a securely closed box. The door in this embodiment has a horizontal slot for mail which is protected from the elements with a conventional hinged panel. In one embodiment, an auxiliary receptacle for mail is provided on one side of the mail box, preferably towards the front and comprises a rectangular receptacle with the upper side edges slanted downwardly from the back. A cover hinged to the top of the back when closed slants forwardly and rests on the tops of the side and front. The front edge of the cover extends over the top of the front to protect the contents from the elements. The back of the auxiliary receptacle is secured to a side of the mail box usually by welding.

ILLUSTRATIVE SPECIFIC EMBODIMENT

In the accompanying drawing the mail box of the present invention is indicated in general by the numeral 2. The mail box 2 has a front door which may be moved between an open position and a closed position. The door 4 is provided with a handle 6.

The mail box further includes sides 8 and 10 which are preferably made integrally with the roof 22 which has a left roof section 24 and a left roof section 26 divided by roof ridge 28. A floor 16 or bottom for the mail box 2 is secured between the sides 8 and 10 and attached to the sides by welding downwardly extending flanges 18 of the floor 16 to the interior of side wall 8 and the opposite similar flange 20 to the interior of side wall 10. The box is closed in the rear by rear wall 12 which is welded to the rear edges of the floor 16, wall 8 and 10 and the roof 22.

A conventional metal flag 14 is pivotally mounted on the right wall on a pivot pin 30 and when down rests on stop pin 32 extending from the side wall 10.

A mounting post bracket or receiver 34 is secured to the lower surface of the floor 16 by welding flange 36 which extends laterally from the top of the bracket 34 to the floor 16.

A door stop jamb or 38 comprising shaped angle iron is secured to and runs parallel to walls 8 and 10, and the roof sections 24 and 26 as shown in FIG. 3, 4, 6 and 7. Sections 40 and 42 are preferably formed integrally with the main portion 38.

Figure 3:
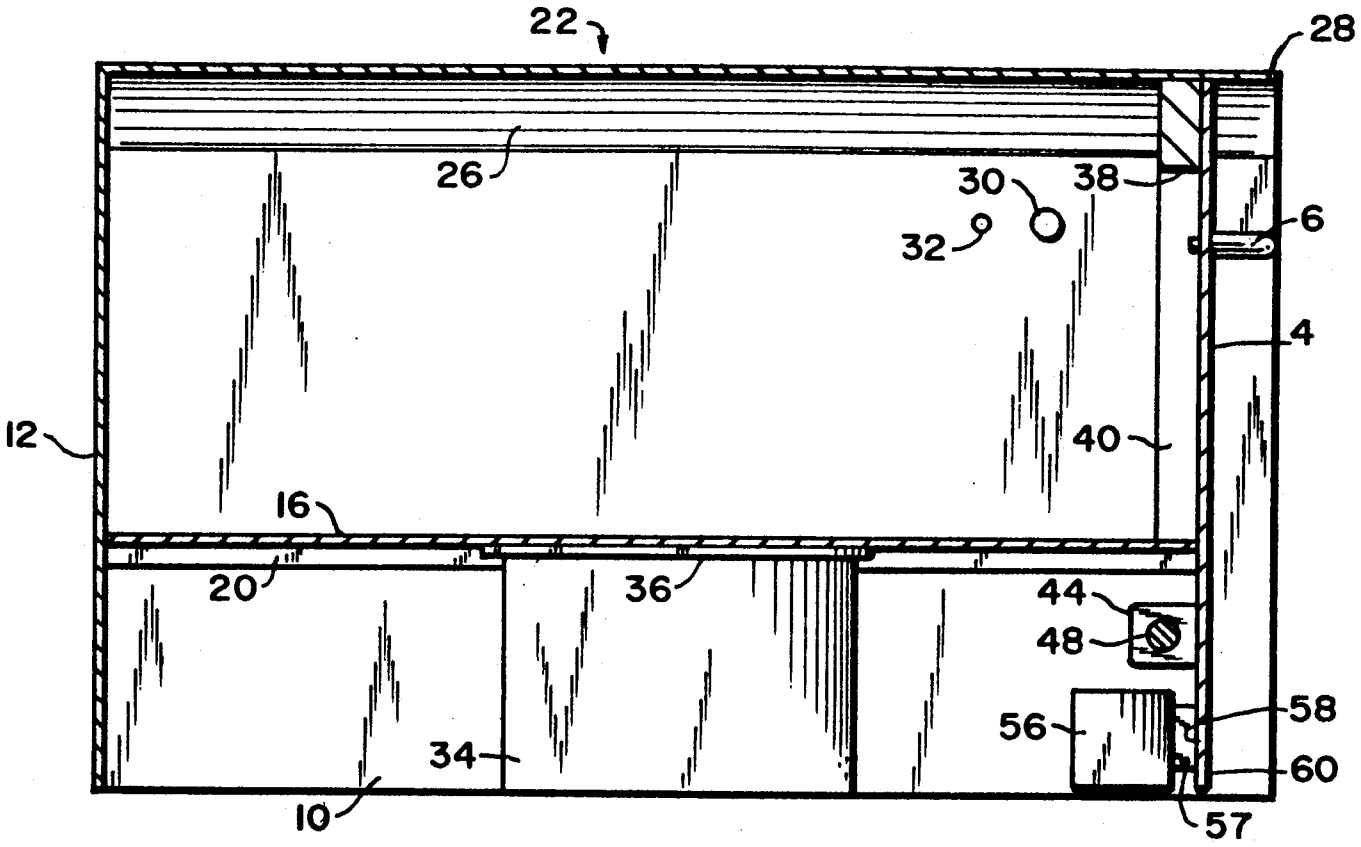
FIG. 3 is a section from the interior of the mail box taken along line 3—3 of FIG. 1.
Figure 4:
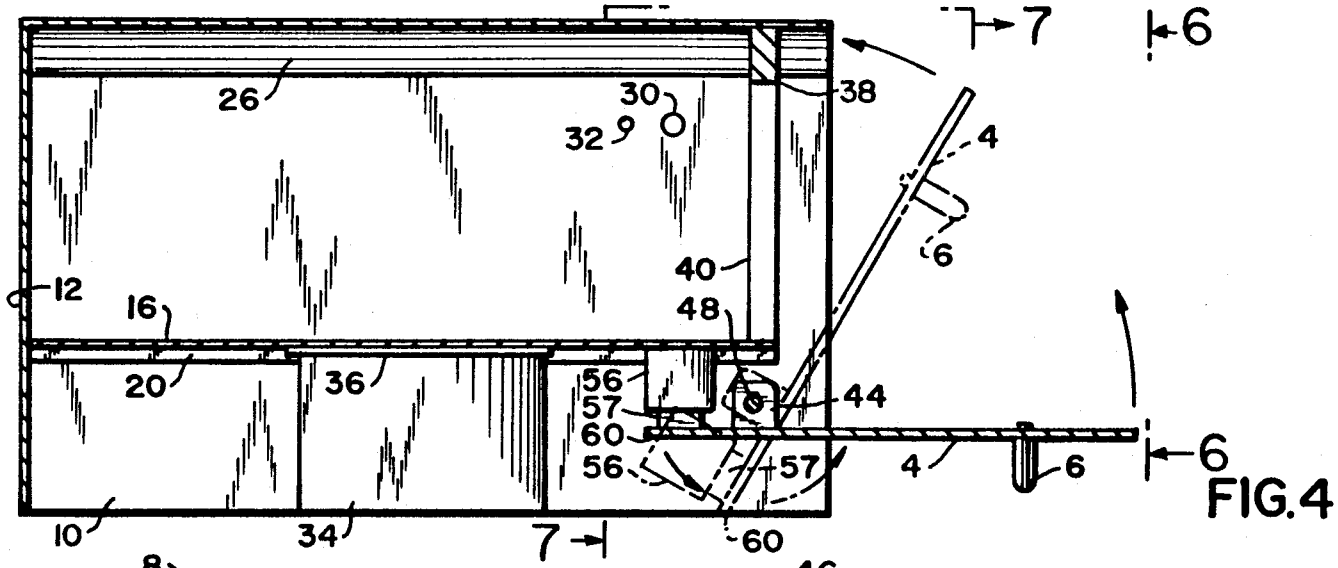
FIG. 4 is a view similar to FIG. 3, but with the door in the open position with an intermediate position shown in phantom.
Figure 5:
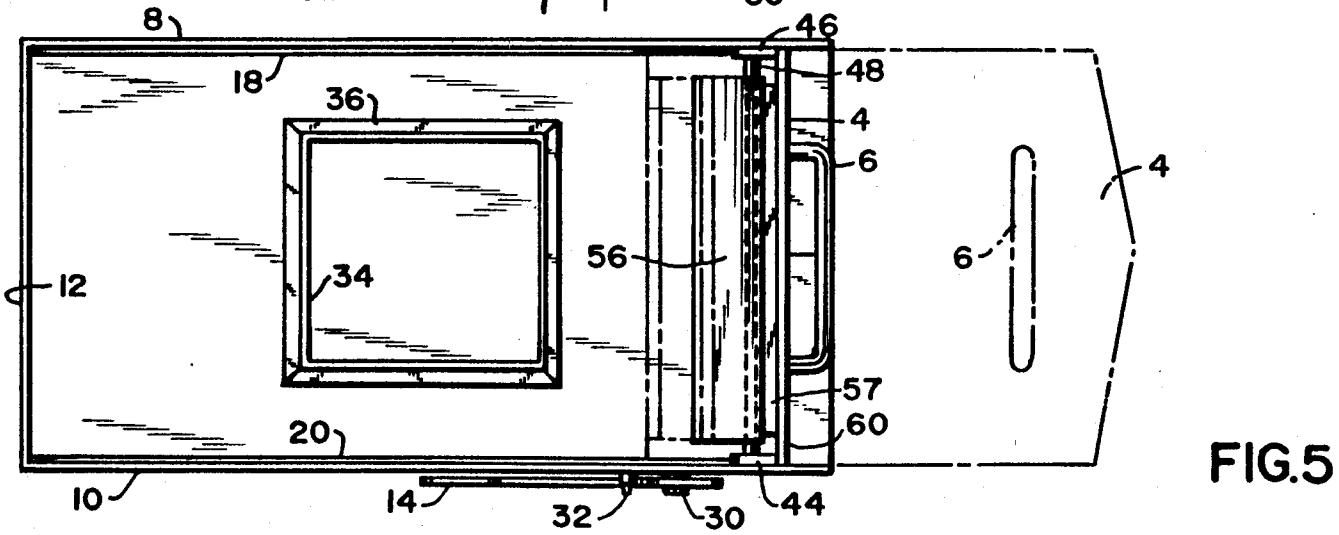
FIG. 5 is a bottom view of the mail box taken along lines 5—5 of FIG. 1 showing the door in the closed position and the door in the open position in phantom.
Figure 6:
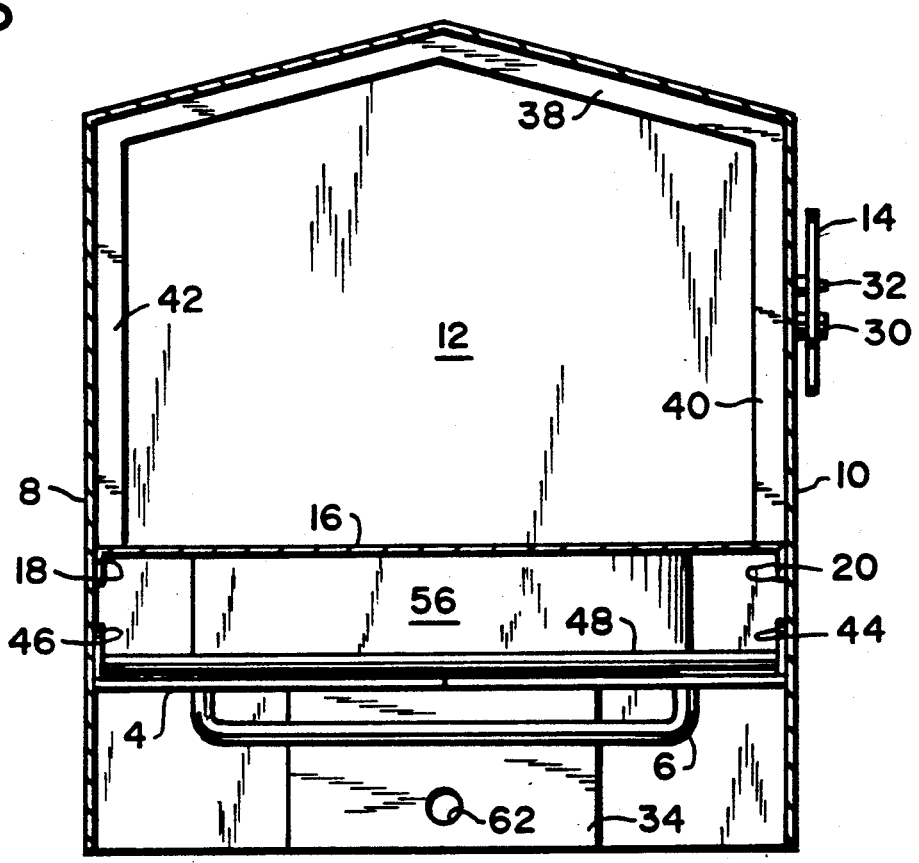
FIG. 6 is a front view of the mail box with the door in the open position along line 6—6 of FIG. 4.
Figure 7:
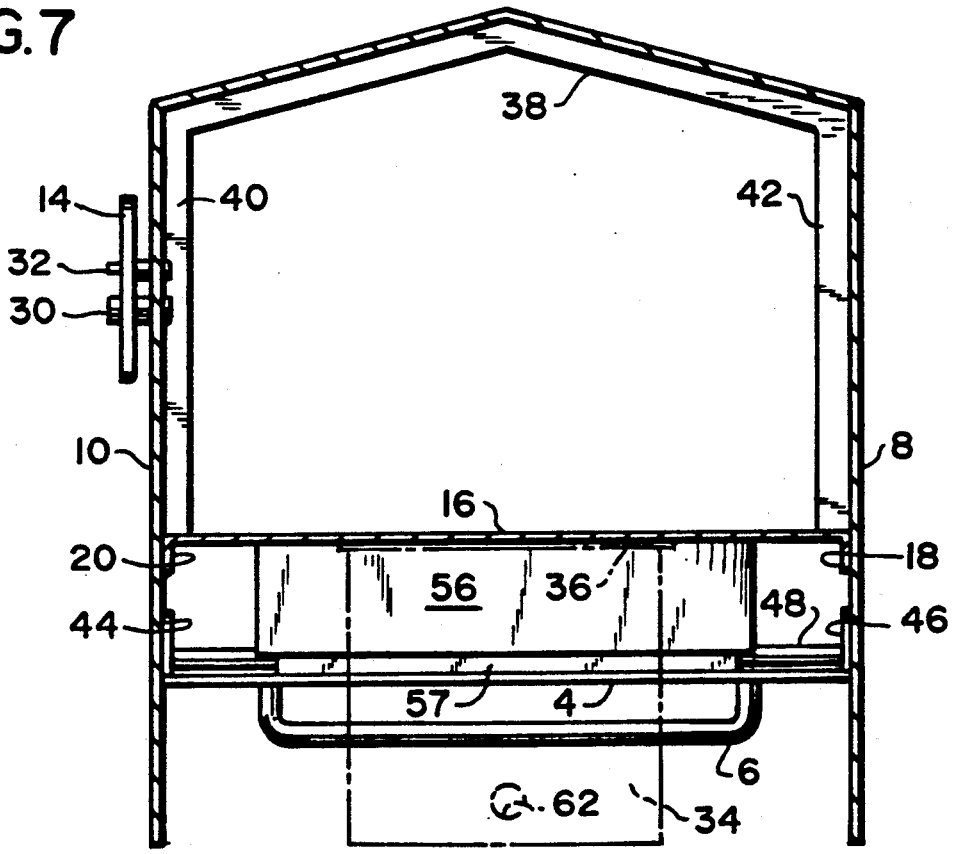
FIG. 7 is a rear view of the mail box with the door in the open position along line 7—7 of FIG. 4.

As best shown in FIGS. 3 and 4, the stop 38 is recessed from the front edges of the roof and side walls 8 and 10 so that the roof 22 overhangs the door 4 to protect the opening from the elements.

Figure 2:
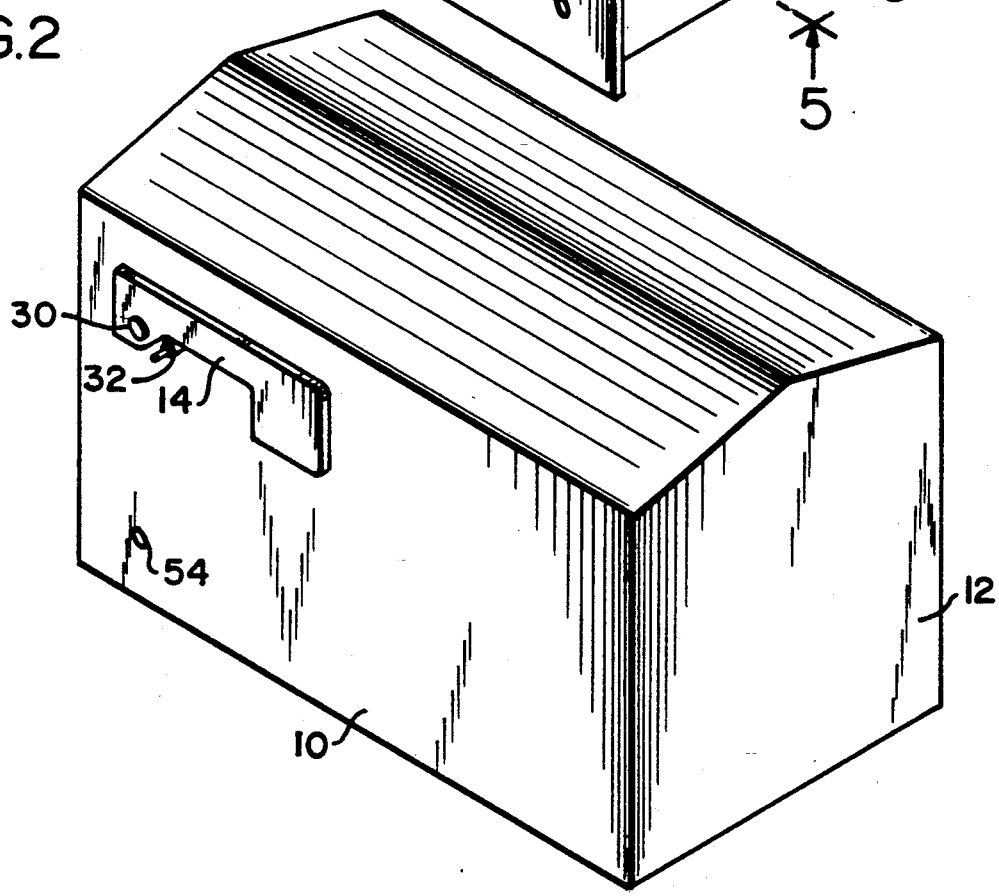
FIG. 2 is a perspective view showing the rear and the right other side of the mail box shown in FIG. 1.

The inner side of the door 4 is hinged by secured between the sides 8 and 10 below level of the floor 16. A pair of hinge flanges 44 and 46 respectively are secured on the inner surface of the door 4 as shown. The flanges have annular apertures 48 and 50, respectively, through which the hinge pin 52 passes. The pin 52 has a diameter slightly less than that of the apertures 48 and 50. The pin 52 is welded at the ends thereof to the side walls 8 and 10 by spot weld 54 as indicated best in FIGS. 1 and 2.

Secured to the lower portion 58 of the inner surface 60 of the door 4 below the hinge 48 is a counterweight 56. The counterweight 56 is mounted on a support for 57 secured to the door surface by adhesive or welding. This serves to assure that the door is automatically closed after each usage.

The post receiver 34 has apertures 62 in the sides thereof to facilitate securing it to a mounting post with nails, screws or bolts. Alternatively the receiver 34 may be welded to the post if metal posts are utilized.

Figure 8:
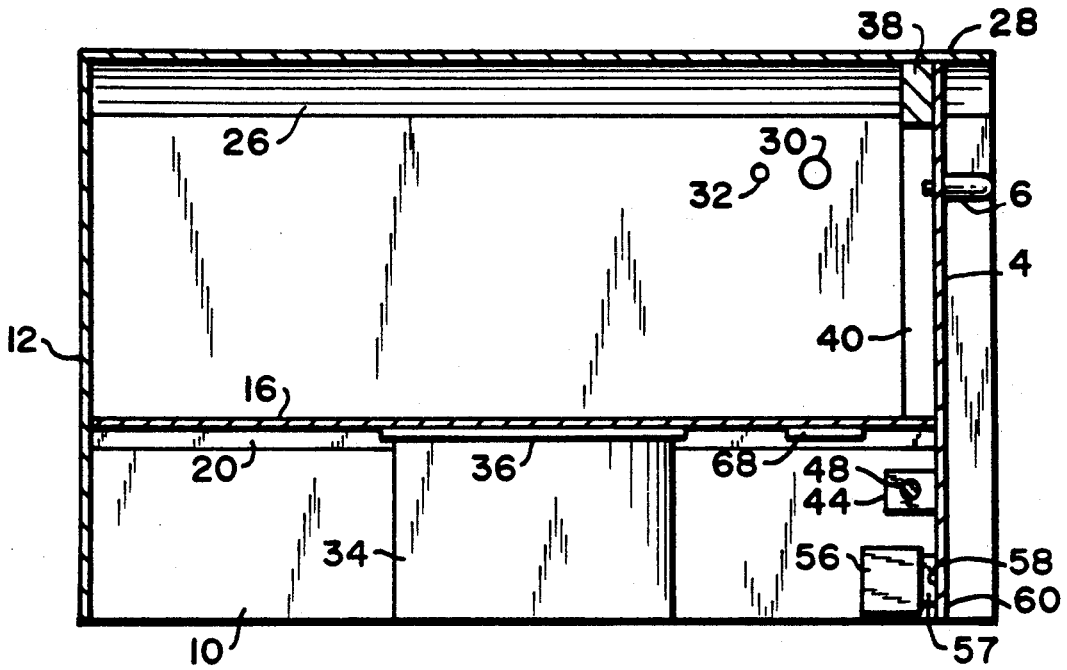
FIG. 8 is a side view taken along lines 8—8 of FIG. 9 of an alternate embodiment of the invention utilizing magnetic means to hold the door in the open position.
Figure 9:
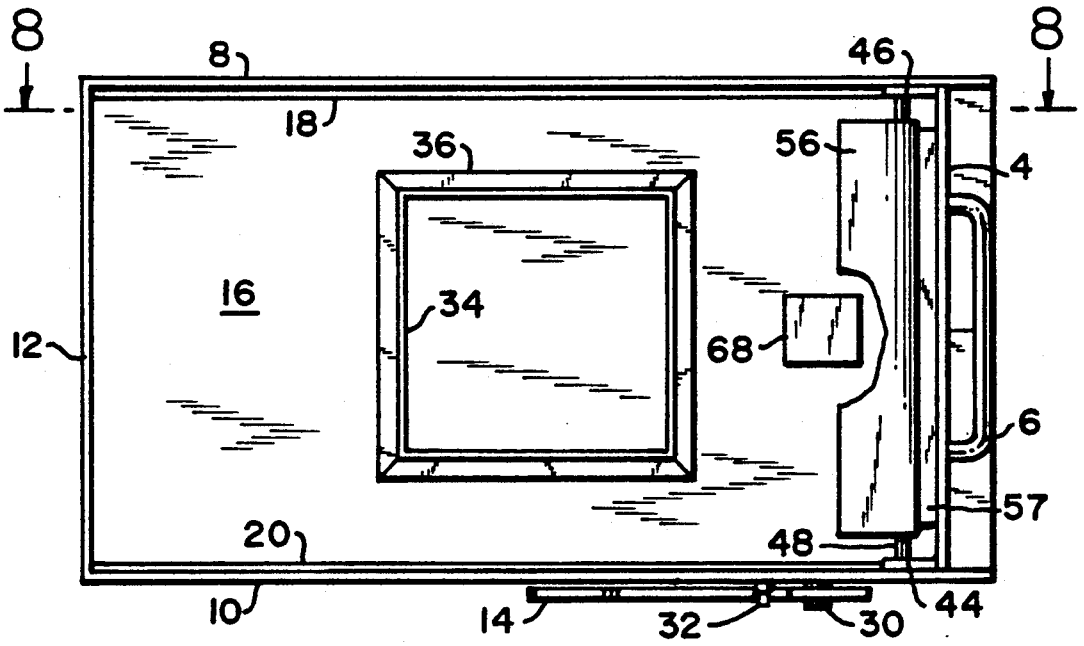
FIG. 9 is a bottom view of an alternate embodiment.
Figure 10:
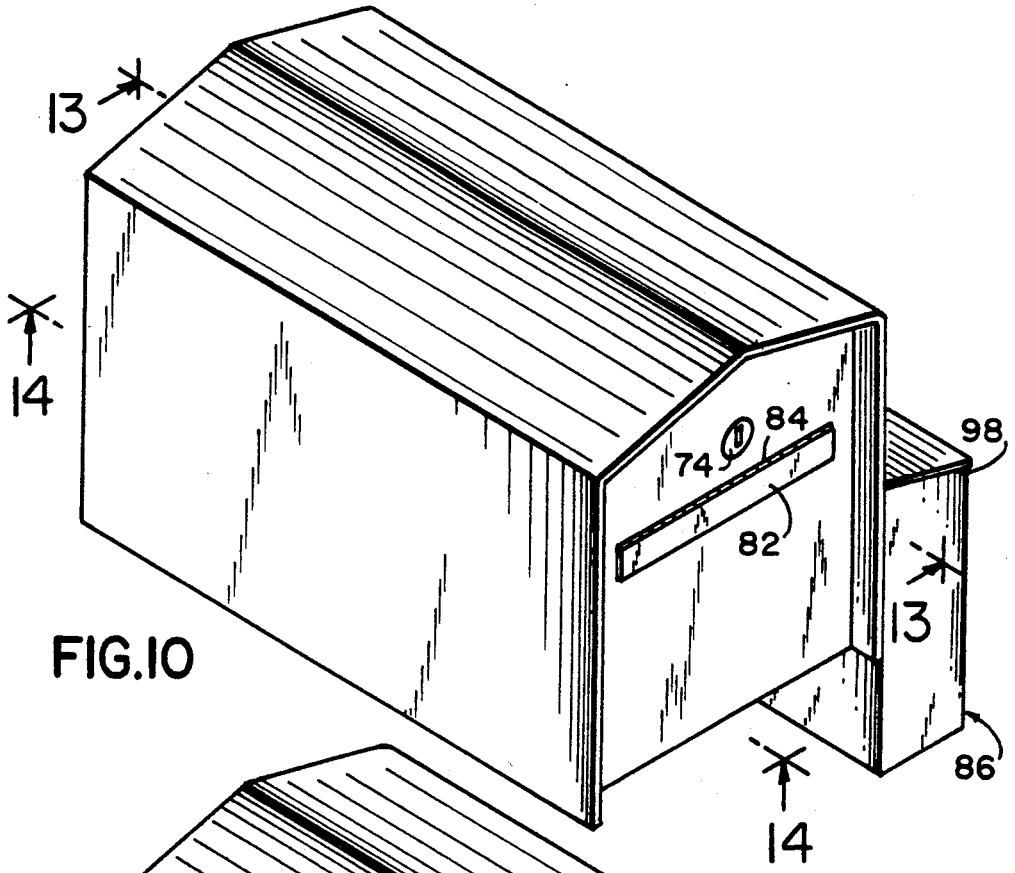
FIG. 10 is a perspective view of the front and one side of second alternate embodiment utilizing an auxiliary receptacle on one side of the box for retaining mail to be picked up, and including a lock for the door of the mail box and covered slot in the self-closing door.
Figure 11:
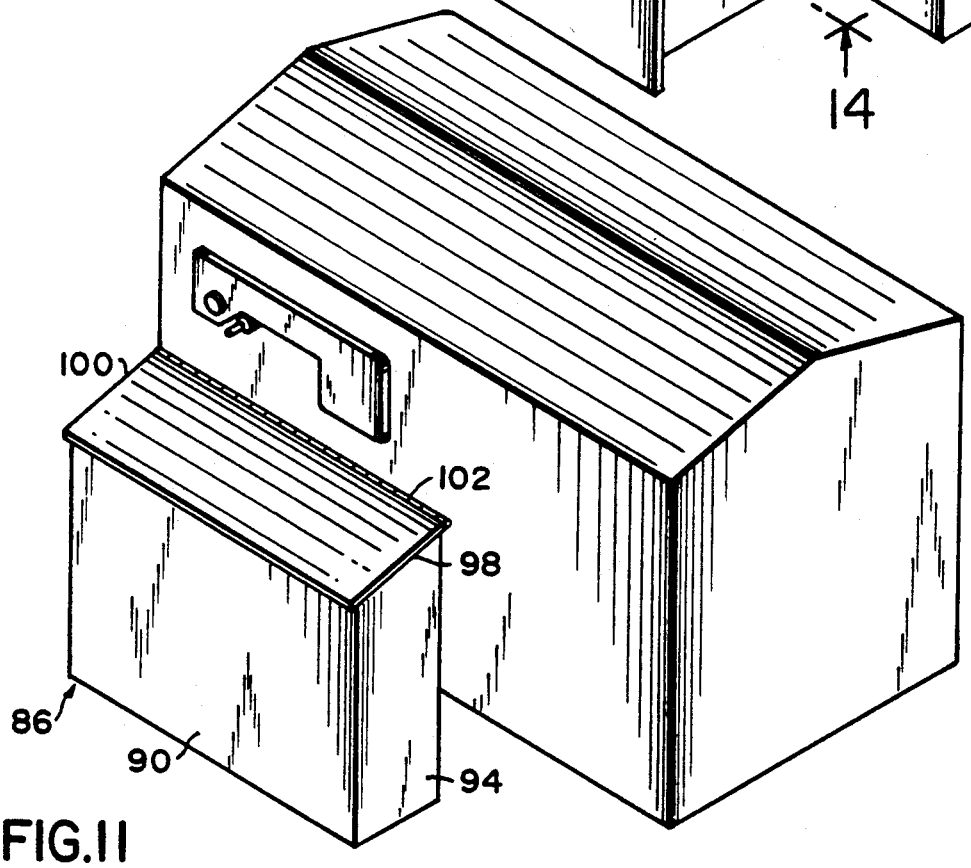
FIG. 11 is a perspective view of the rear and the opposite side of the box shown in FIG. 10 showing the auxiliary box mounted on the main mail box.

The alternative embodiment shown in FIGS. 8 and 9 is in all respects the same as that in FIGS. 1–8 except that a magnet 68 is secured to the lower surface of the floor 16 towards the front of the mail box so as to come into contact with the counterweight 56 when the door 4 is moved to the fully open position.

This allows the door to remain open while items are placed in, or removed from, the mail box 2 and thus enabling the users to utilize both hands for such tasks.

Figure 12:
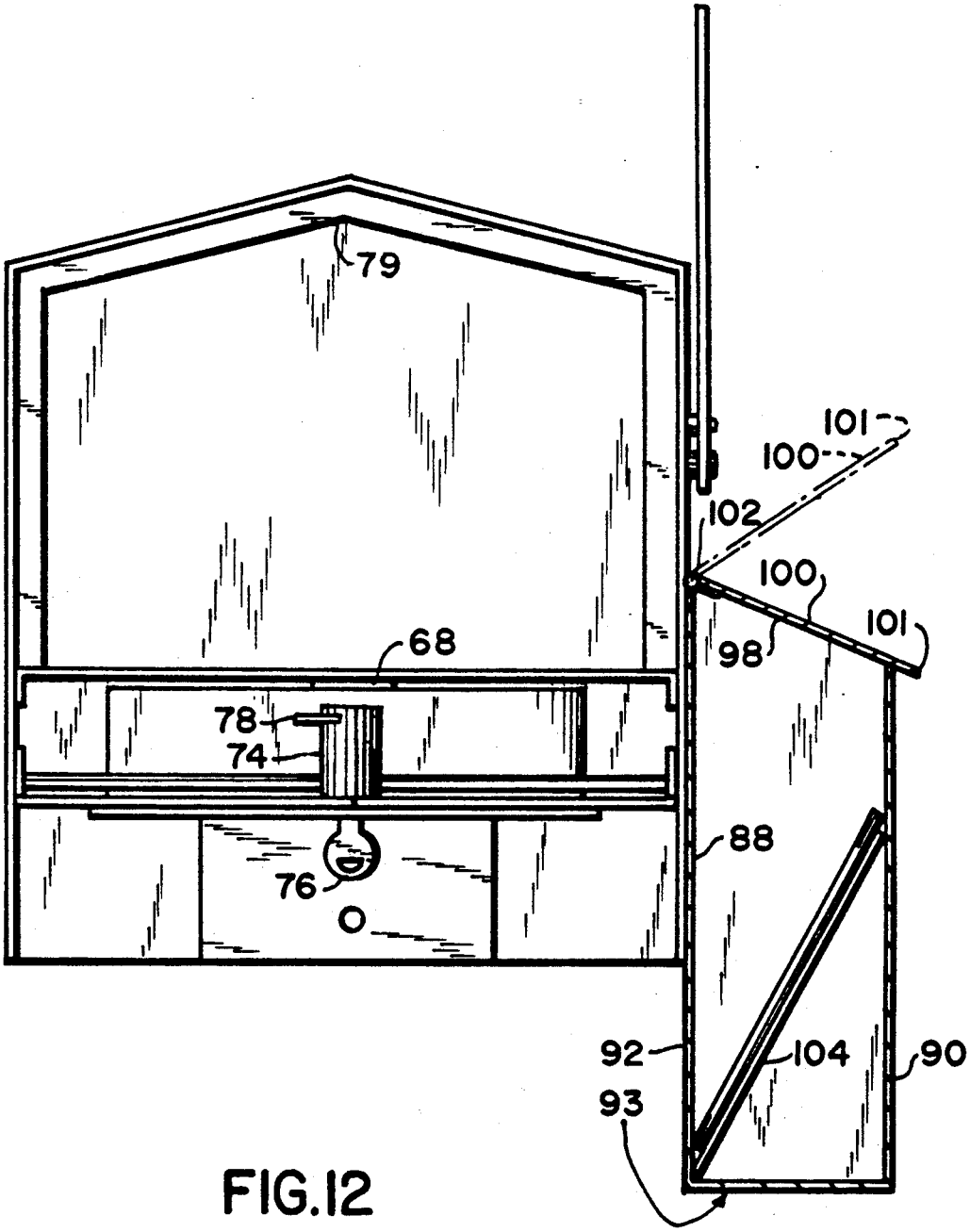
FIG. 12 is a front view of the embodiment of FIG. 10–11 showing the interior of the auxiliary box, and the door of the mail box itself in the open position.
Figure 13:
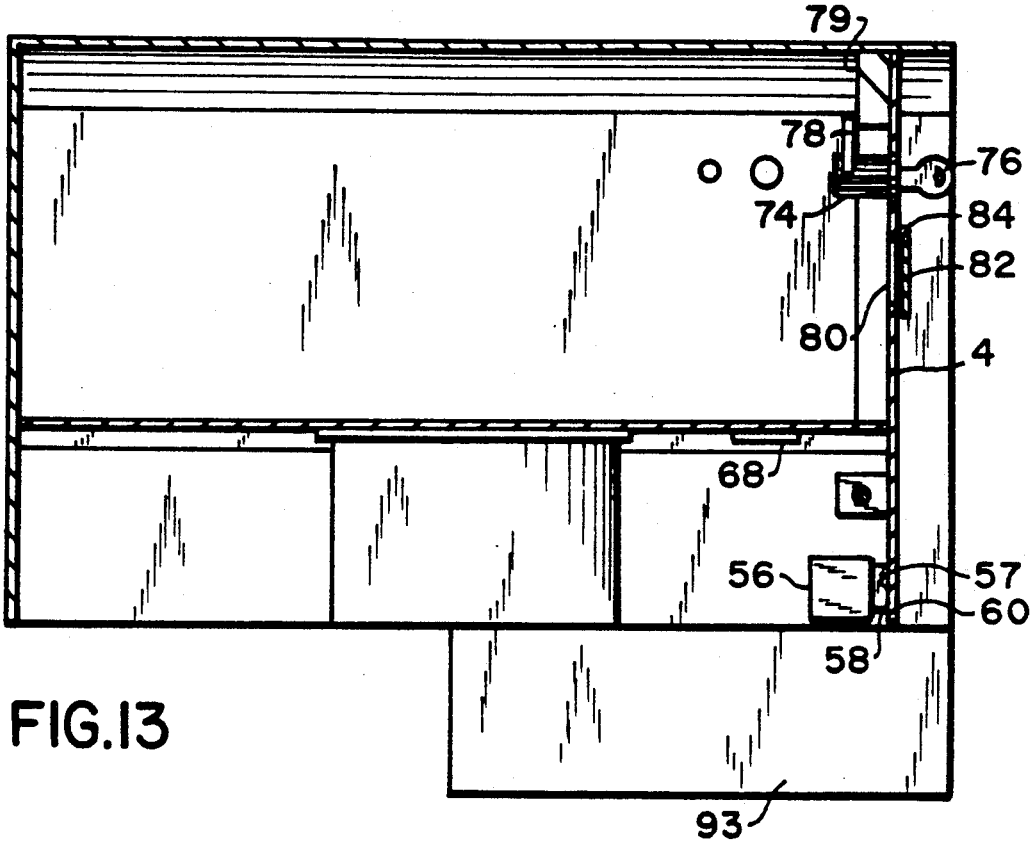
FIG. 13 is a side view, partially in section along lines 13—13 of FIG. 10.
Figure 14:
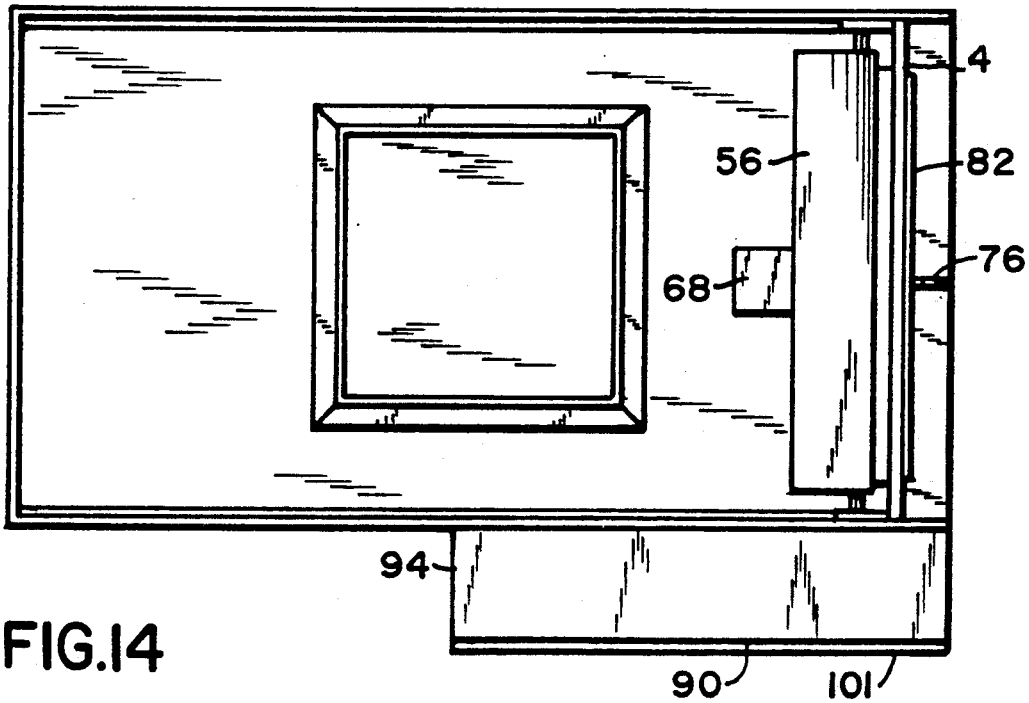
FIG. 14 is a bottom view along line 14—14 of the embodiment of the device as shown in FIG. 10.

In FIGS. 10–14 another embodiment is illustrated wherein the door 4 is provided with a cylinder lock 74 operated by the key 76. The operation of the lock 74 is such that the turning of the key 76 when inserted in the lock 74 moves a latch arm 78 that is connected to the lock 74 from a locked position as shown in FIG. 13 in the locked position behind door joint 34 as shown at 78 to a position clear of the first joint or door stop 34.

In this embodiment the door 4 is provided with a horizontal slot opening 80 which is normally covered by a hinged door panel 82 which is hinged to the mail box door 4 along its top edge by a jamb type of hinge 84 container. In this embodiment the auxiliary container 86 is secured to the lower front portion of one side of the box 2 as shown.

This auxiliary container includes a back 88, front 90, sides 94, and a bottom floor 93. The upper edges 98 of the sides 94 are slanted downwardly from the back wall 88 to the front 90 as best shown in FIG. 12 to facilitate shedding rains and the like from the top cover door 100 which is hinged at its inner edge to the top end of the back 88 by piano hinge 102. The cover door 100 is constructed with an extension 101 which extends on the top edge of the wall 90 to protect the letter contents 104 from the elements.

The auxiliary container 86 is secured to the side wall of the box 2 welding the back wall 88 of the container 86 to one of the sides 8 or 10 of the mail box 2.

The walls 8 and 10, rear wall 12 and door 4 of the mail box 2 all extend below the level of the floor 16 in effect to form a skirt to shield the post received from view and also conceal the counter weight 56 and magnet 68 from view when the door 4 of the box 2 is closed which adds immensely to the appearance of the device.

The design of the mail box 2 of the present invention assures a positive closure of the door 4 of the use, and provides a strong, secure receptacle for mail.

The alternative embodiments further assure convenience and security by the provision to temporarily hold the door 4 open when placing or removing mail from the mail box 2 due to the temporary magnetic hold.

When security is a primary consideration the locked door latch embodiment with an auxiliary pick-up container is available with only minor modification in the basic construction.

While the invention has been described by reference to an illustrative embodiment, it is not intended that the novel device be limited thereby, but that modifications thereof are intended to be included as falling within the broad spirit and scope of the foregoing disclosure, the following claims and the appended drawings.

While the invention has been described by reference to an illustrative embodiment, it is not intended that the novel device be limited thereby, but that modifications thereof are intended to be included as falling within the broad spirit and scope of the foregoing disclosure, the following claims and the appended drawings.

What is claimed is:

1. A mail box comprising spaced apart side walls, roof, rear wall, and a floor spanning the area between said walls and secured to inner surfaces of said side walls and spaced upwardly from lower edges of said walls; a horizontally, pivotally mounted door for closing a front opening of said mail box defined by said side walls and said roof, said door having a pull handle on the upper portion of its outwardly facing surface, said door being hingedly mounted on a pivot hinge pin secured at either end thereof to the inner surface of said side wall and below the plane of said floor; and a counterweight mounted on the inner surface of a lower portion of said door and below said floor surface, so that when said door is opened said counterweight contacts a bottom surface of said floor, said counterweight automatically closing said door when said door is not held open.

2. A mail box as claimed in Claim 1 wherein said door is provided with a horizontal slot therein in communication with the interior space defined by said walls, floor and roof, and locking means on said door.

3. A mail box as claimed in claim 1 wherein a magnet is secured to the lower surface of said floor and located so as to be in contact with said counterweight of said door when said door is fully opened.

4. A mail box as claimed in claim 3 wherein said door is provided with a horizontal slot therein in communication with the interior space defined by said walls, floor and roof, and locking means on said door.

5. A mail box as claimed in claim 1 wherein an auxiliary mail receptacle is secured to the outer surface of one of said sides of said mail.

6. A mail box as claimed in claim 5 wherein said door is provided with a horizontal slot therein in communication with the interior space defined by said walls, floor and roof, and locking means on said door.

* * * * *